United States Patent [19]

Sasaki et al.

[11] Patent Number: 4,725,819

[45] Date of Patent: Feb. 16, 1988

[54] FIRE DETECTION SYSTEM

[75] Inventors: Koju Sasaki, Tokyo; Hirofumi Fujii, Saitama; Seiichi Tanaka, Chiba; Tetsuo Kimura, Tokyo, all of Japan

[73] Assignee: Nittan Company, Limited, Tokyo, Japan

[21] Appl. No.: 61,908

[22] Filed: Jun. 11, 1987

Related U.S. Application Data

[63] Continuation of Ser. No. 787,911, Oct. 16, 1985, abandoned, which is a continuation of Ser. No. 459,388, Jan. 20, 1983, abandoned.

[30] Foreign Application Priority Data

Jan. 26, 1982 [JP] Japan ..... 57-9535

[51] Int. Cl.[4] ..... G08B 23/00

[52] U.S. Cl. ..... 340/517; 340/506; 340/511; 340/531; 340/870.09; 340/870.16; 340/870.17; 340/870.21

[58] Field of Search ..... 340/517, 518, 505, 506, 340/510, 511, 870.21, 870.22, 870.16, 870.17, 870.09, 500, 825.06, 825.07, 825.08

[56] References Cited

U.S. PATENT DOCUMENTS

| | | | |
|---|---|---|---|
| 3,516,063 | 6/1970 | Arkin et al. | 340/518 |
| 3,925,763 | 12/1975 | Wadhwani et al. | 340/505 |
| 4,103,337 | 7/1977 | Whiteside | 340/505 |
| 4,228,424 | 10/1980 | LeNay et al. | 340/506 |
| 4,287,508 | 9/1981 | Arita et al. | 340/518 |
| 4,339,746 | 7/1982 | Ulicki et al. | 340/518 |
| 4,367,458 | 1/1983 | Hackett | 340/506 |
| 4,464,653 | 8/1984 | Winner | 340/870.21 |

FOREIGN PATENT DOCUMENTS 1338375 11/1973 United Kingdom .

*Primary Examiner*—Donnie L. Crosland

*Attorney, Agent, or Firm*—Abelman Frayne Rezac & Schwab

[57] ABSTRACT

A fire sensing unit is provided with apparatus which sends out a code identifying the type of sensor apart from transmission of the quantized signals of the analog output of the sensor of the sensing unit. Thus the data processing unit of the receiving unit of a fire detection system including the sensor can be simplified because the receiving unit need not collate the types of the installed sensors with a list of addresses stored therein. Also replacement of sensors can be easily effected since the information regarding the type of sensors is stored in the sensing unit.

4 Claims, 1 Drawing Figure

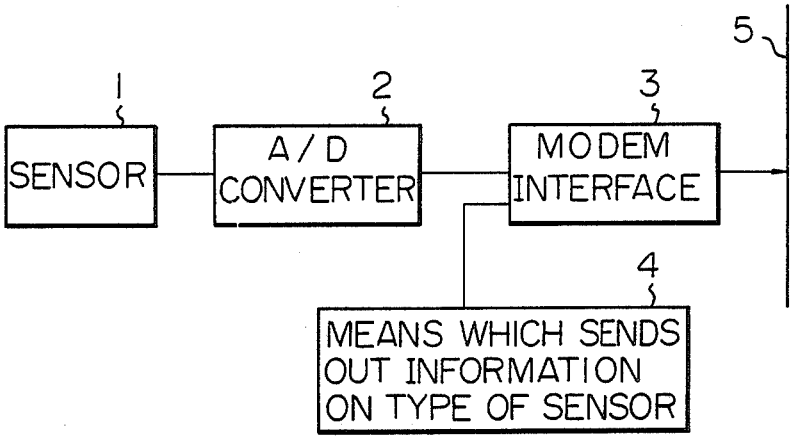
5
1
2
3
SENSOR
A / D CONVERTER
MODEM INTERFACE
4
MEANS WHICH SENDS OUT INFORMATION ON TYPE OF SENSOR

FIRE DETECTION SYSTEM

This is a continuation of Application Ser. No. 787,911 filed on Oct. 16, 1985, abandoned is a Rule 60 Continuation Application of U.S. Ser. No. 459,388 filed Jan. 20, 1983, now abandoned.

TECHNICAL FIELD OF THE INVENTION

This invention relates to a fire detection system. More particularly, this invention relates to a fire detection system, wherein a plurality of analog sensors of different types are connected to a pair of alarm links, the output of each analog sensor is converted into quantized codes (signals) which are sent out on the alarm lines, and the sent-out signals are decoded and processed by a data processing means on the receiving unit side, whereby the conditions of any fire which has occurred can be monitored.

BACKGROUND OF THE INVENTION

In order to obtain detailed information on the conditions of a fire which has occurred, it is insufficient to use a single type of fire detector and fire detectors of different types, for example, an ionization type smoke sensor, a photoelectric smoke sensor, and a heat sensor, should be used in combination. In this case, the receiving unit of the fire detection system must determine the type of sensor before it can analyze the information that the sensor transmits.

In the conventional fire detection system, a separate address is allotted to each analog sensor, and all the address signals are constantly and successively sent out from a receiving unit to the analog sensors through an alarm line or some other kind of line. When an analog sensor receives the address signal allotted thereto, it converts its analog output into a quantized code which is sent out on the alarm line or some other line. Even the conventional fire detection system as described above can determine the type of sensor and judge and respond to the signal in accordance with the type of the sensor in question, since a separate address is allotted to each sensor and the information on the type of the sensor of which the address signal has been sent out is stored in the receiving unit.

In the conventional system, however, a complicated data-processing means has to be provided because it is necessary to provide a list for comparing the addresses and the types of the sensors. Recently such a list can be stored rather easily by means of a read only memory (ROM), but employment of a ROM impairs interchangeability between sensors of different types. Further, if the list is stored in a random access memory (RAM), a complicated program is required for rewriting the list upon any change in the sensor types.

The object of this invention is to provide a fire detection system wherein the above-mentioned defects of the conventional art are eliminated, the burden on the software for the receiving unit is reduced, and sensors can easily be replaced with those of different types.

DISCLOSURE OF THE INVENTION

This invention provides in the fire detection system, wherein a plurality of analog sensors of different types are connected to a pair of alarm lines, output signals of each sensor are converted into quantized codes to be sent out on the alarming lines and a data processing means is provided for receiving and decoding the quantized codes to monitor the condition of a fire in a receiving unit, an improved system characterized in that a code is assigned to each type of analog sensors and each analog sensor is accompanied by a means which sends out the code on the type of sensor.

According to this invention, a complicated data-processing means for a comparison list of the addresses and types of the sensors can be eliminated in the receiving unit. And a sensor can be easily replaced with another of a different type.

The invention will now be described in detail with reference to the accompanying drawing.

BRIEF DESCRIPTION OF THE DRAWING

The sole drawing is a block diagram showing the concept of the sensing unit used in this invention.

DETAILED DESCRIPTION OF THE INVENTION

As seen in the FIGURE the sensing unit used in the fire detection system of this invention comprises a sensor 1, an AD converter 2, a modem interface 3 and a means 4 to send out information on the type of sensor.

In FIG. 1, a sensor 1 may be an ionization type smoke concentration sensor, a photoelectric smoke concentration sensor, a sensor or a sensor of any other type. The sensor generates an output signal corresponding to the sensed environmental condition of the place where the sensor is installed. The AD converter 2 converts the output signal of the sensor 1 into a quantized code and sends out it as a digital signal. when the modem interface 3 receives an address signal sent from the receiving unit through an alarm line 5 or some other line, if the received signal coincides with the address allotted thereto, it sends out the output signal of the means 4 for sending out information on the type of sensor and then sends out the output signal of the AD converter 2 on the alarm line 5 or some other line.

The code concerning the type of the sensor is assigned so that, for example, 0001 designates an ionization type smoke concentration sensor, 0010 a photoelectric smoke concentration sensor, 0101 a heat sensor, 0110 a heat sensor of another type, 1001 an infrared flame detector, 1010 a ultraviolet flame detector, etc.

The means 4 for sending out information (a code) on the type of sensor is, for instance, provided with a clock pulse oscillator of a fixed frequency and a serial register. In the register, the code on the type of sensor is stored. When the modem interface detects that the received address signal coincides with its own address assigned thereto, it sends out the information on the type of sensor, for instance, by first sending out a start bit and then the code on the type of sensor stored in said serial register with the timing of the clock pulses of said oscillator in accordance with a start-stop synchronizing system and finally sending out a stop bit. The start bit and the stop bit may be stored in the register together with the code concerning the type of sensor.

Alternatively, the means 4 for sending out information on the type of sensor, is, for example, constructed with a ROM and a parallel-serial converting register is provided in the modem interface 3 so that the read-only code coming from the ROM may be converted to a signal to be output by means of said converting register.

On the receiving unit side, the received signal is decoded and a corresponding program is called up in accordance with the information concerning the type of sensor and the smoke concentration, the temperature etc. is determined in accordance with the received quantized digital signal, and thus the condition of any fire that has occurred is judged and properly displayed. For example, the output signal of an ionization type smoke concentration sensor when there is no smoke is stored beforehand in the memory of a data processing means, and an alarm is raised when the difference between the signal coming from the ionization type smoke concentration sensor and the stored signal for non-existence of smoke exceeds a predetermined value. Or, if a heat sensor is used, the signal coming from the heat sensor will be converted into a temperature signal. Appropriate processing will be effected according to the type of the sensor in question.

In the above explanation, recognition of each individual sensor is not touched upon. But this can be easily effected in accordance with the known art.

In the fundamental embodiment as mentioned above a code for the type of sensor and a quantized code from the sensor are sent out as a pair. However, if a command requesting only the codes on the type of sensors is sent out when a program is initiated, and the received codes are stored, and quantized codes are received later, a faster transmission speed is achieved. Those skilled in the art can easily construct such a fire detection system without deviating from the scope of this invention. In either case, it suffices if the information on the type of sensors is stored in the sensor side, and can be sent out as desired.

Further, the AD converter 2 converts the output signals of the sensor 1 to quantized digital signals and the quantization, of course, includes an encoding operation whereby an ON operation or an OFF operation is established. depending upon whether the output of the sensor 1 is higher or lower than a predetermined value. For example, an ordinary ionization type smoke sensor, which is an analog sensor, merely short-circuits the alarm lines when the output voltage of the smoke sensor exceeds a predetermined value. This invention is also applicable to such a digital conversion sensing unit.

As stated above, in this invention, information concerning the type of sensor is stored on the sensor side and is sent out from the sensor side when required. With this construction, the program in the data processing means of the receiving unit can be made simple and it is not required to provide a list etc. for the type of sensors against the addresses. Further, a sensor can easily be replaced with another of a different type on the spot, because the information concerning the type of sensors is stored in the sensing unit. It is possible to grasp the conditions of a fire more accurately by providing sensors of appropriate types corresponding to the environement of the places where sensors are installed. Morever, the designing of the fire detection system is made easier.

We claim:

1. In a fire detection system of the type including a central receiving unit and plural sensing units located at positions remote from said central receiving unit, each said sensing unit incorporating means providing an electrical output signal indicative of conditions sensed by the sensing unit at the particular location of that sensing unit, and which is operatively connected to said central receiving unit by alarm lines, the improvement comprising:

each said sensing unit additionally incorporating an electrical code producing signal means indicative of the specific type of the sensing unit with which the said electrical code signal producing means is associated, and which is operatively connected via said alarm lines to said central receiving unit and is operative to send information as to the type of the associated sensing unit to said receiving unit separately from information as to conditions sensed by that sensing unit;

whereby, on request by said central receiving unit, each said sensing unit is capable of announcing to said central receiving unit the specific type of the specific sensing unit addressed by said central receiving unit.

2. A fire detection system according to claim 1, wherein said means for producing said code signal produces said code signal before said sensing means produces said output signal.

3. A fire detection system according to claim 1 wherein said code signal and said output signal are produced through said pair of alarm lines to said receiving unit when they are requested by a command from said receiving unit.

4. A fire detection system according to claim 1 wherein said sensing means includes an A/D converter for converting said output signal into a quantitized code.

* * * * *